US005783904A

United States Patent [19]

Liu et al.

[11] Patent Number: 5,783,904

[45] Date of Patent: Jul. 21, 1998

[54] HIGH LUMINESCENCE DISPLAY

[75] Inventors: David Nan-Chou Liu, Chutung; Jammy Chin-Ming Huang; Jin-Yuh Liu, both of Taipei, all of Taiwan

[73] Assignee: Industrial Technology Research Institute, Hsin-Chu, Taiwan

[21] Appl. No.: 851,430

[22] Filed: May 5, 1997

Related U.S. Application Data

[62] Division of Ser. No. 494,631, Jun. 23, 1995, Pat. No. 5,655,941.

[51] Int. Cl.[6] ..... H01J 29/10

[52] U.S. Cl. ..... 313/495

[58] Field of Search ..... 445/52, 24; 313/497, 313/495; 430/25

[56] References Cited

U.S. PATENT DOCUMENTS 4,251,610 2/1981 Haven et al. ..... 430/25

5,097,175 3/1992 Thomas ..... 427/68 X 5,650,690 7/1997 Haven ..... 313/497 X

*Primary Examiner*—Kenneth J. Ramsey

*Attorney, Agent, or Firm*—George O. Saile; Stephen B. Ackerman

[57] ABSTRACT

A high luminescence display, and methods for making such a display, are described. A faceplate for a display device having a glass face is provided, having phosphor elements on the glass face. There are reflective elements, on the glass face and adjacent to the phosphor elements, with surfaces angled toward the phosphor elements, whereby light emitted from the phosphor elements reflects off the reflective elements and travels through the glass face. The reflective elements may be formed of, for example, aluminum, and be directly adjacent to the phosphor, or offset from it.

11 Claims, 8 Drawing Sheets

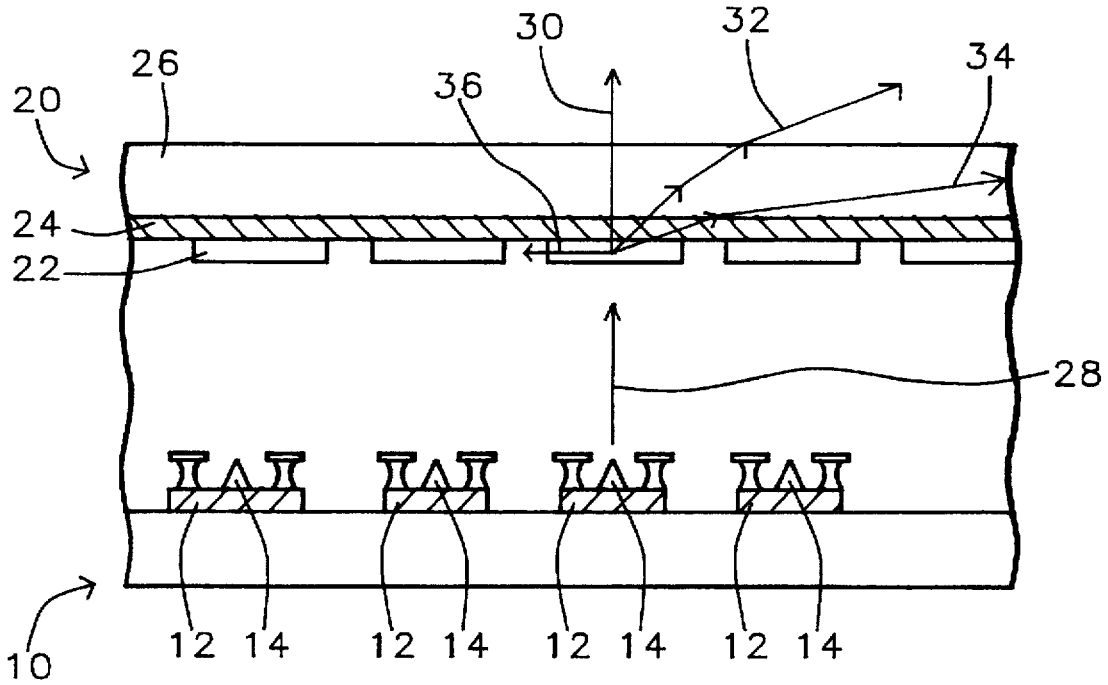
FIG. 1 – Prior Art
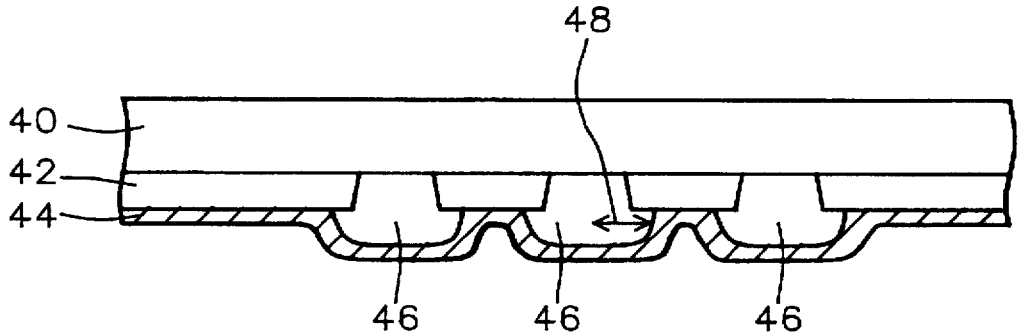
FIG. 2 – Prior Art

HIGH LUMINESCENCE DISPLAY

This application is a divisional of application Ser. No. 08/494,631, filed Jun. 23, 1995 and now U.S. Pat. No. 5,655,941.

BACKGROUND OF THE INVENTION (1). Field of the Invention

The invention relates to display devices, and more particularly to structures and methods of manufacturing video displays having high luminescence.

(2). Description of the Related Art

In video display technology, the traditional structure of the phosphor pattern on the display faceplate leads to loss of luminescence, or brightness. When emitted electrons, from an an electron gun in a CRT (Cathode Ray Tube) device or from field emission structures in an FED (Field Emission Display), strike phosphor elements on the faceplate, light energy in the form of photons are emitted and travel in various directions out of the phosphor.

FIG. 1 illustrates a typical FED, in which there is a backplate 10 having cathode stripes 12 and electon-emitting elements 14, mounted opposite and parallel to a faceplate 20 having phosphors 22, anode 24 and glass face 26. Electrons 28 are emitted from elements 14 in the presence of a strong electric field, and are accelerated toward the anode 24, which is raised to a voltage higher than the cathode. As electrons 28 strike the phosphors 22, light in the form of photons is emitted. Some light 30 travels directly through the glass face and may be viewed by an observer looking at the display. Other light which strikes the anode 24 and glass 26 at other than normal angles is bent due to the differing indices of refraction of the various elements. For example, the refractive index of phosphor is more than 2.5, while that of ITO (indium tin oxide), a typical anode material, is 2.0, and glass is about 1.5. This causes some light 32 to exit the glass at low angles, and other light 34 to never exit the glass. Further, some light 36 is emitted from the phosphor parallel to or away from the 36 glass face and never exits.

It is estimated that at least 35% of the phosphorescent light is lost due to these mechanisms. This light loss generates heat inside the display. As heat builds up, phophorescence will saturate due to the thermal quench effect. As the temperature increases, the phosphorescence chroma changes and the brightness of the phosphorescence decreases.

FIG. 2 illustrates a faceplate for a CRT of the prior art. Phosphors 46 are formed between contrast-providing elements (black matrix) 42, and are covered by aluminum layer 44. Light 48 that is emitted parallel to or away from the glass face 40 is lost in internal reflection off the aluminum and does not enhance display brightness. Other disadvantages in the fabrication of this structure include the requirement of four separate lithographic steps (one for each of the three color phosphors, assuming a color CRT, and one for the black matrix), and a lack of self-alignment of the phosphors to the black matrix.

SUMMARY OF THE INVENTION

It is therefore an object of this invention is to provide a display with increased luminescence.

It is a further object of this invention to provide a display which does not suffer from the problems of phosphor heating.

Another object of this invention is to provide a very manufacturable method of fabricating a display with increased luminescence.

These objects are achieved by a faceplate for a display device having a glass face, and phosphor elements on the glass face. There are reflective elements, on the glass face and adjacent to the phosphor elements, with surfaces angled toward the phosphor elements, whereby light emitted from the phosphor elements reflects off the reflective elements and travels through the glass face. The reflective elements may be formed of, for example, aluminum, and be directly adjacent to the phosphor, or offset from it.

These objects are further achieved by a method of manufacturing a high luminescence display in which a faceplate having a glass face is provided. A transparent conductive layer is formed over the glass face. A layer of phosphor slurry is formed over the transparent conductive layer. The phosphor slurry is exposed and developed to form a plurality of phosphor elements having sloped sides. A reflective layer is formed over the phosphor elements. A plurality of contrast-providing elements is formed over the transparent conductive layer and between the phosphor elements. A baseplate having a plurality of electron-emitting elements, and a means for causing the electron-emitting by field emission, is mounted parallel and opposite to the faceplate.

These objects are further achieved by a method of manufacturing a high luminescence display in which a faceplate having a glass face is provided, and a transparent conductive layer is formed over the glass face. A photoresist mask is formed over the transparent conductive layer, the photoresist mask having a plurality of openings and sloped sides. A plurality of contrast-providing elements is formed in the openings. The photoresist mask is removed, and reflective layer is formed over the contrast-providing elements. A plurality of phosphor elements is formed between the contrast-providing elements. A baseplate having a plurality of electron-emitting elements, and a means for causing the electron-emitting by field emission, is mounted parallel and opposite to the faceplate.

These objects are also achieved by a method of manufacturing a high luminescence display in which a faceplate having a glass face is provided, and a transparent conductive layer is formed over the glass face. A plurality of contrast-providing elements is formed over the transparent conductive layer. The transparent conductive layer is patterned by an isotropic etch using the contrast-providing elements as a mask. A plurality of phosphor elements having sloped sides is formed adjacent to the contrast-providing elements and to the etched transparent conductive layer. A reflective layer is formed over the phosphor elements, and a baseplate having a plurality of electron-emitting elements, and a means for causing the electron-emitting by field emission, is mounted parallel and opposite to the faceplate.

These objects are still further achieved by a method of manufacturing a high luminescence displays, in which a faceplate having a glass face is provided, and a first photoresist mask is formed over the transparent conductive layer. The transparent conductive layer is patterned to remain only under the first photoresist mask. A layer of contrast-providing material is formed over the glass face and the first photoresist mask, and is then developed. The first photoresist mask is removed, and a second photoresist mask is formed, having sloped sides, over the patterned transparent conductive layer and partially over the contrast-providing material. A reflective layer is formed over the second photoresist mask and that portion of the contrast-providing material not covered by the second photoresist mask. A paste layer is deposited over the reflective layer, and those portions of the paste layer and the reflective layer that are located over the second photoresist mask are removed. The second photoresist mask is removed. A plurality of phosphor elements is formed between the contrast-providing material and over the conductive transparent layer, and a baseplate having a plurality of electron-emitting elements, and a means for causing the electron-emitting by field emission, is mounted parallel and opposite to the faceplate.

BRIEF DESCRIPTION OF THE DRAWINGS

FIG. 1 is a cross-sectional representation of a prior art field emission display.

FIG. 2 is a cross-sectional representation of a prior art CRT faceplate.

DESCRIPTION OF THE PREFERRED EMBODIMENTS

Figure 3:
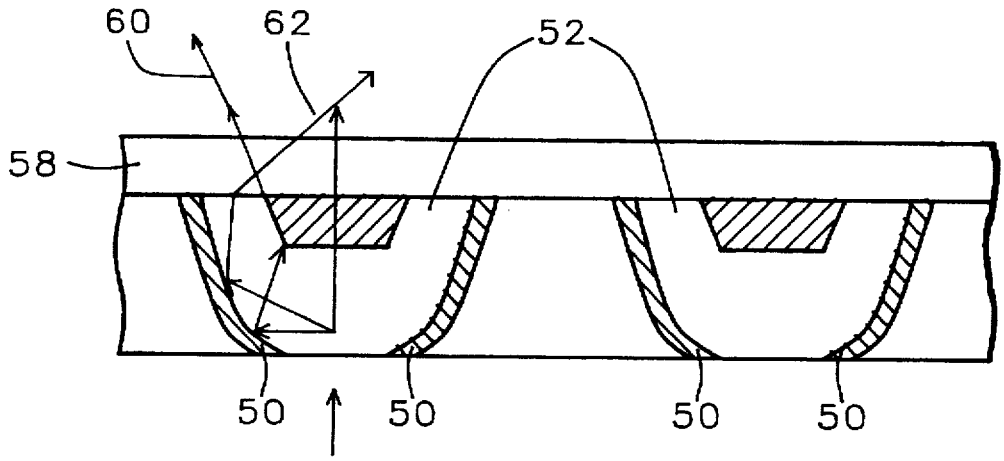
FIGS. 3 and 4 are cross-sectional representations of novel structures of the invention, in which sloped reflective layers adjacent to disply phosphor increase display brightness.
Figure 4:
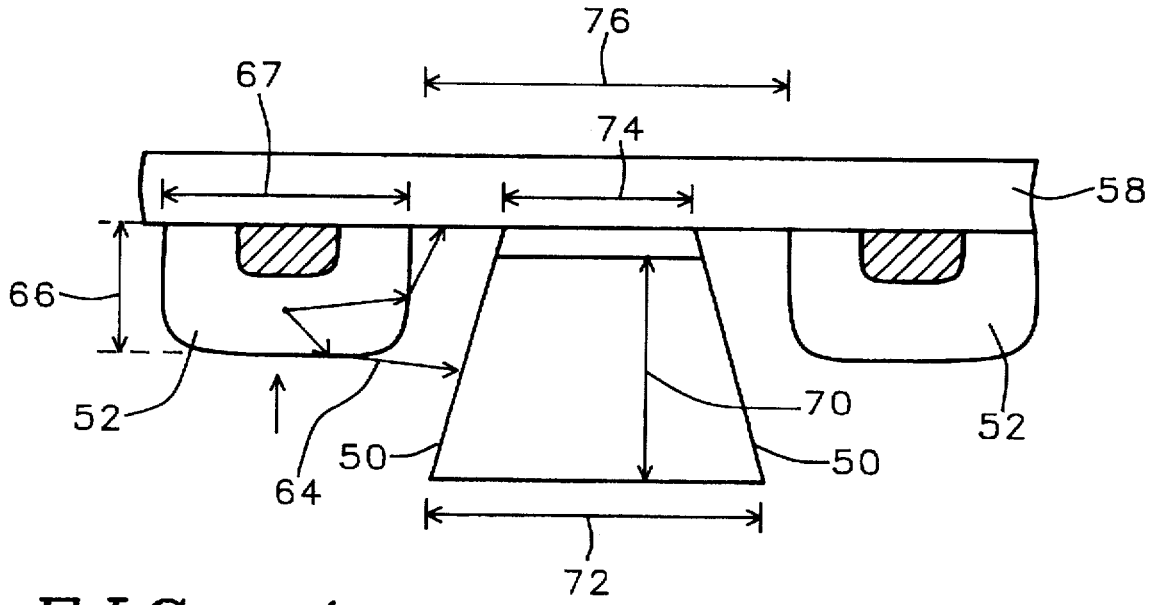
Figure 5:
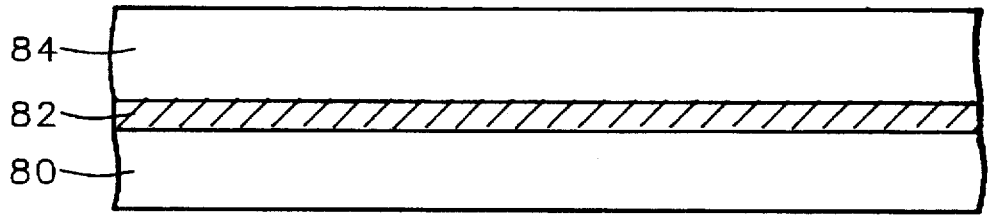
FIGS. 5 to 9 are a cross-sectional representation for one method, and resultant structure, of the invention for forming a highly luminescent display faceplate.
Figure 6:
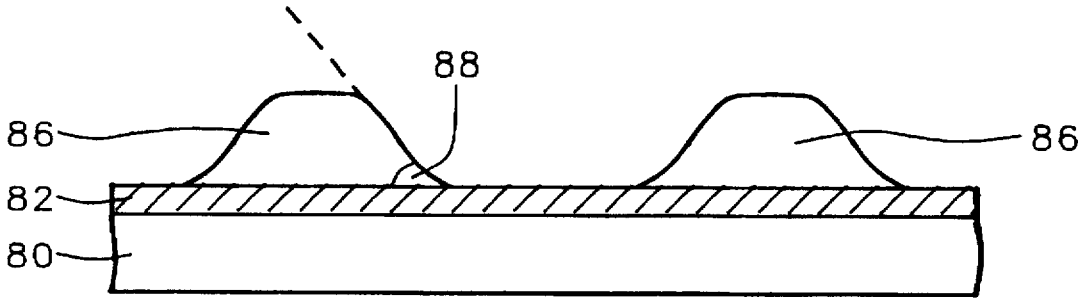

Referring now to FIGS. 3 and 4, two structures of the invention are shown. It may be understood that various changes in form and detail from these preferred embodiments could be made without departing from the scope of the invention. With reference to FIG. 3, the novel faceplate structure of the invention is shown. A key aspect of the invention is the sides of the reflective layer 50, which are sloped toward the phosphors 52. This sloped reflective layer provides a surface for reflection of light emitted from the phosphors 52, causing light that would otherwise be lost internally within the display to travel out through the glass face 58. Two examples are light 60 and. 62. Light 60, emitted parallel to the glass face and which in the prior art structures would never exit through the display face, reflects off layer 50 and transparent anode 54 and out through the glass face 58. Light 62 that in the prior art structure would be emitted at such a low angle that it would be lost in internal reflection in the glass, in the structure of the invention reflects off layer 50 and out through the glass for viewing.

A second structure of the invention is shown in FIG. 4, in which similar elements are denoted by the same reference characters. In this embodiment, the sloped sides 50 of reflective element 68 are offset from the phosphor 52, and due to this offset and the height of the reflective element, even some light 64 exiting through the bottom of the phosphor is reflected out through the glass face and provides additional brightness.

Some representative dimensions of the FIG. 4 faceplate structure follow. It will be understood by those of ordinary skill in the art that these dimensions may be varied without exceeding the scope of the invention. For a typical FED application, the phosphor 52 has a height 66 of between about 15 and 25 micrometers and a width 67 of between about 50 and 300 micrometers. Reflective element 68 has a height 70 of between about 40 and 60 micrometers, and a width 72 of between about 80 and 100 micrometers, while the width 74 at its base is between about 40 and 60 micrometers. Lastly, the distance between phosphors 76 is between about 90 and 110 micrometers.

Several methods for forming these structures will now be described. The first method of the invention, and the resultant structure, is shown in FIGS. 5 to 9. A transparent glass faceplate 80 is provided, having a thickness of between about 0.7 and 1.1 millimeters. A transparent conductive layer 82, formed from oxides of indium, tin, zinc and cadmium, such as indium tin oxide (ITO), indium zinc oxide (IZO), cadmium stannate (CTO) and the like, is deposited to a thickness of between about 0.1 and 0.3 micrometers, by sputtering. In an FED, the transparent conductive layer 82 will act as an anode.

A phosphor slurry 84 is next deposited to a thickness of between about 15 and 25 micrometers, by spinning it on, and consists of water, polyvinyl alcohol (PVA), phosphor and dichromate, where the PVA and dichromate are used for photosensitizing. This layer is then exposed through a mask to UV (ultraviolet) light, and developed with water to form the pattern of FIG. 6. This results in phosphor elements 86 that have sloping sides with an angle 88 of between about 45 and 75 degrees, the angle depending on variables during exposure and developing such as exposure energy and time, and developer concentration and developing time.

Figure 7:
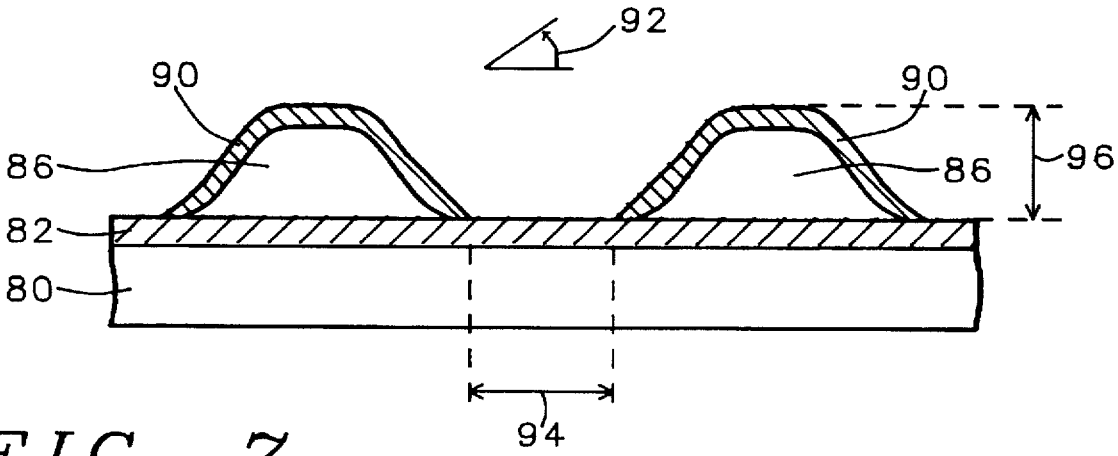

Referring now to FIG. 7, a reflective layer 90 is now formed over the phosphor 86, and is formed at the same angle as the sloped sides of the phosphor. One method of forming this layer is by the angle evaporation of aluminum (Al), while rotating the faceplate at an angle 92 of about 15 degrees. This results in aluminum being deposited on the top and sides of the phosphor but not on the transparent conductive layer 82. In FIG. 7, the dimensions 94 and 96 for the distance between phosphors and the height, respectively, are each about 20 micrometers, although this could be varied if, for example, a higher resolution display was desired, in which case the phosphor elements would need to be formed closer together.

Figure 8:
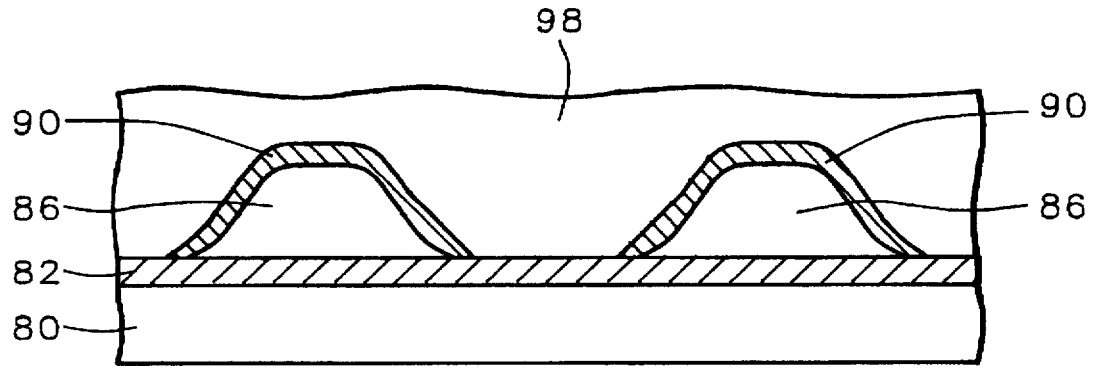

With reference to FIG. 8, carbon paste is sprayed on and is used to provide improved contrast between phosphors. This black coating 98, e.g., a dag spray, is applied to a thickness of between about 20 and 30 micrometers. Optionally, before the dag spray is applied the transparent conductor 82 may be patterned (not shown) using the phosphor elements as a mask, so that the conductor remains only under the phosphor elements. Patterning of an ITO conductor could be performed by etching with hydrochloride acid, and would be done for FED's in which it was desired to use anode switching, an addressing method in which only certain anode strips are activated during display operation.

Figure 9:
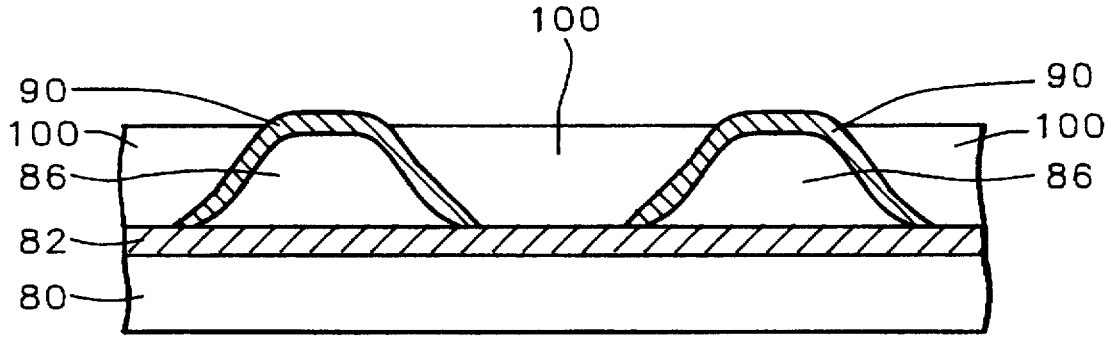

As shown in FIG. 9, the black coating 100, also called black matrix, is etched back to the level of the top of the reflective layer 90 by, for example, CMP (chemical/mechanical planarization). Optionally, the top of reflective layer 90 may also be removed (not shown) during the same etchback step so that the reflective layer is left only on the sloped sides of phosphors 86. The PVA and other organic material is then baked out of the phosphor elements 86 by heating to about 450° C. for about 2 hours. This results in a structure like FIG. 3, and has the added benefits of self-alignment of the black matrix 100 and phosphors 86, and only requires three photolithographic steps, one for each of the red, green and blue phosphors required for a color display.

Figure 10:
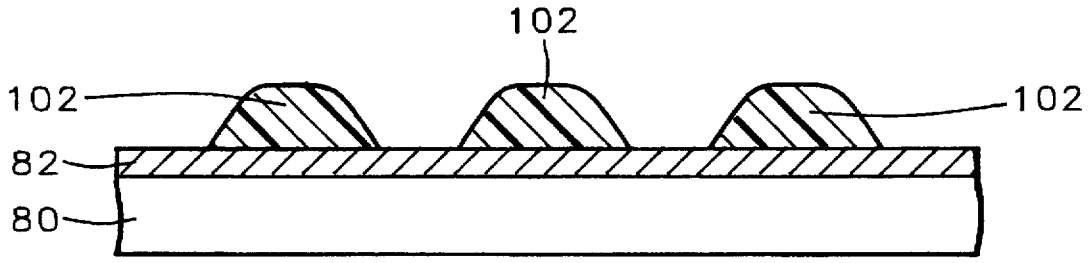
FIGS. 10 to 12 are a cross-sectional representation for a second method, and resultant structure, of the invention.
Figure 11:
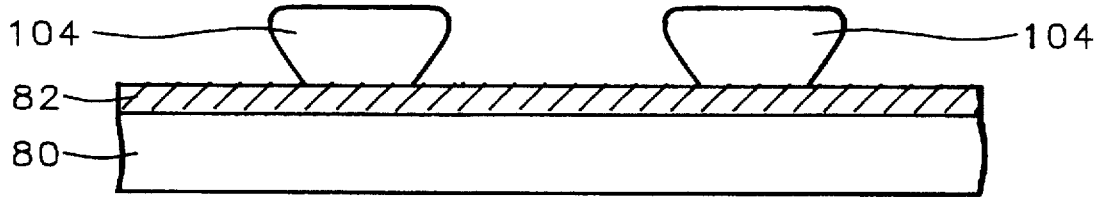

A second method of the invention is now described with reference to FIGS. 10 to 12. Photoresist is spun on the glass/conductor 80/82 and exposed and developed as is well known in the art. This results in photoresist mask 102 having sloped sides. It is known in the art that the edges of photoresist are not vertical after development, but instead have sloped sides as in FIG. 10, as described in *Semiconductor Devices—Physics and Technology*, S. M. Sze, 1985, published by John Wiley & Sons, at p. 437 (FIG. 8(*a*)). Black matrix 104 is formed, as shown in FIG. 11, by coating with dag spray to a thickness of between about 15 and 20 micrometers, followed by development by sulfamic acid followed by water spray. The sides of the black matrix elements 104 take on the slope of the photoresist mask 102, which is subsequently removed.

Figure 12:
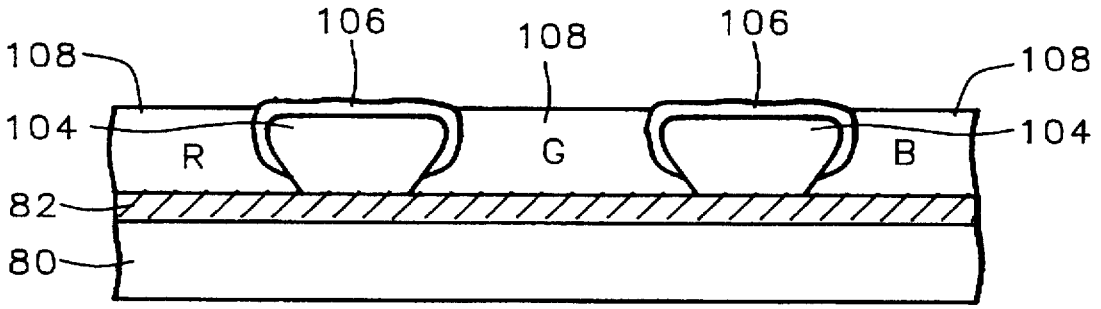

Referring now to FIG. 12, aluminum is angle-evaporated as in the first method of the invention to form reflective layer 106. The top surface may optionally be removed (not shown) by CMP. Finally, phosphor 108 is formed by spin-on and photolithography, as previously described.

Figure 13:
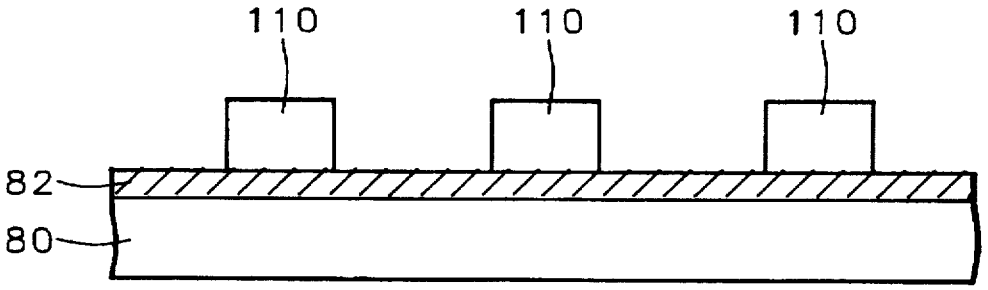
FIGS. 13 to 15 are a cross-sectional representation for third method, and resultant structure, of the invention.
Figure 14:
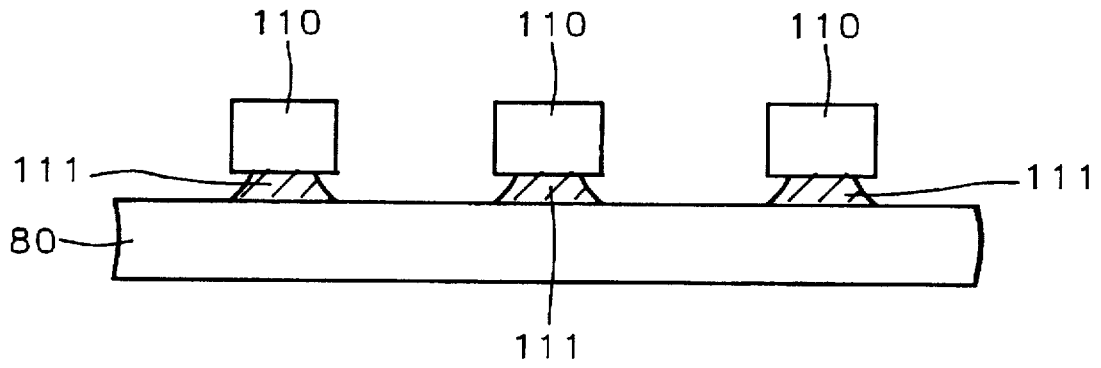
Figure 15:
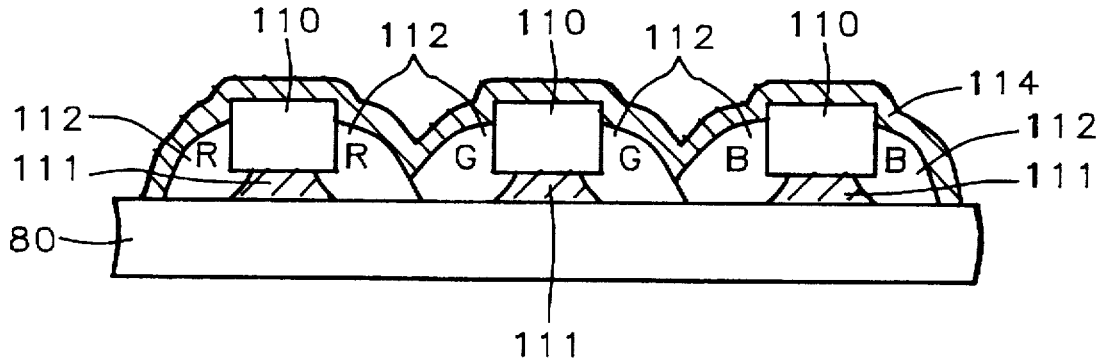

A third method of the invention for forming a high luminescence display is shown in FIGS. 13–15. Black matrix pattern 110 is formed by lithography and etching as noted above. Conductive layer 82 is then etched using, e.g., hydrochloride acid (for ITO), in which the black matrix 110 acts as a mask, which results in conductive elements 111.

Referring to FIG. 15, phosphors 112 are then deposited in a different manner than previously, by electrophoresis. Electrophoresis refers to the motion of charged particles through a suspending medium under the influence of an applied electric field.

This is accomplished by applying a voltage bias to one of the desired conductive elements 111. For a color display, three different phosphors are used to emit red, green and blue light. Three distinct electrophoresis steps would thus be required, one for deposition of each phosphor type. The plate on which the phosphorescent materials are to be deposited is placed opposite another conductive plate, in a solution in which the materials are suspended and in which these materials are charged by means, for example, of an ionizable electrolyte. The charged phosphorescent materials are attracted to the plate on which they are to be deposited by applying an electric field between the two plates. The phosphors 112 are deposited in the area and manner shown in FIG. 15, leading to the desired sloped sides upon which reflective layer 114 is formed, as previously described. The black matrix and phosphor are self-aligned in this method of the invention, and this method has the further advantage of requiring only a single photolithographic step.

Figure 16:
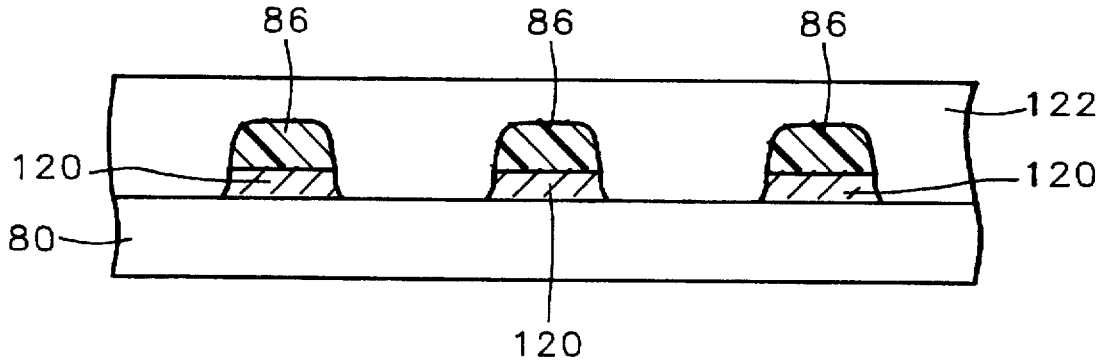
FIGS. 16 to 21 are a cross-sectional representation for a final method, and resultant structure, of the invention.
Figure 17:
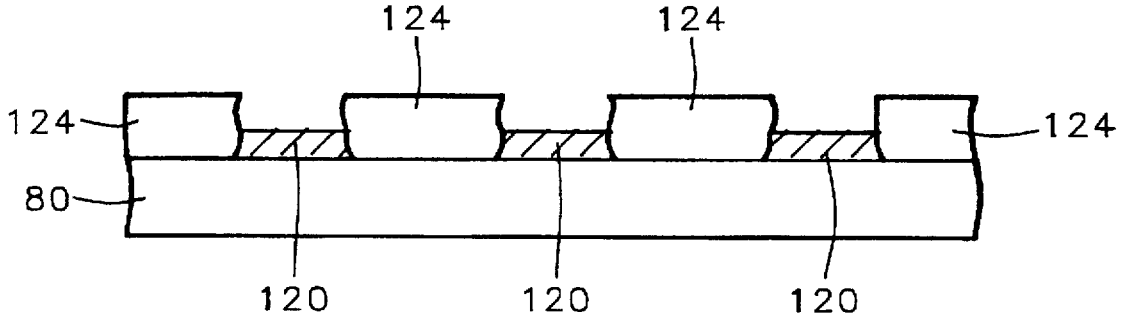

A final method of the invention is described with reference to FIGS. 16–21, and results in the structure of FIG. 4 in which the sloped reflective layer is offset a distance from the phosphors. Beginning with the FIG. 6 structure, the photoresist mask is used as an etch mask for underlying conductive layer 120 which is etched as earlier described. Black matrix 122 is deposited, as shown in FIG. 16, and developed as shown in FIG. 17 to form black matrix elements 124. Development is accomplished by applying sulfamic acid to the FIG. 16 structure, followed by a water spray. This also removes photoresist 86.

Figure 18:
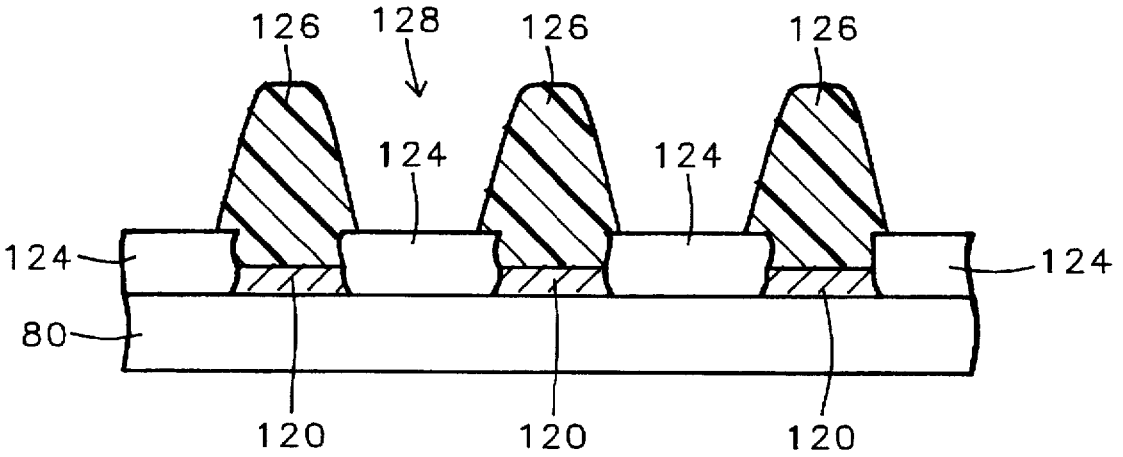
Figure 19:
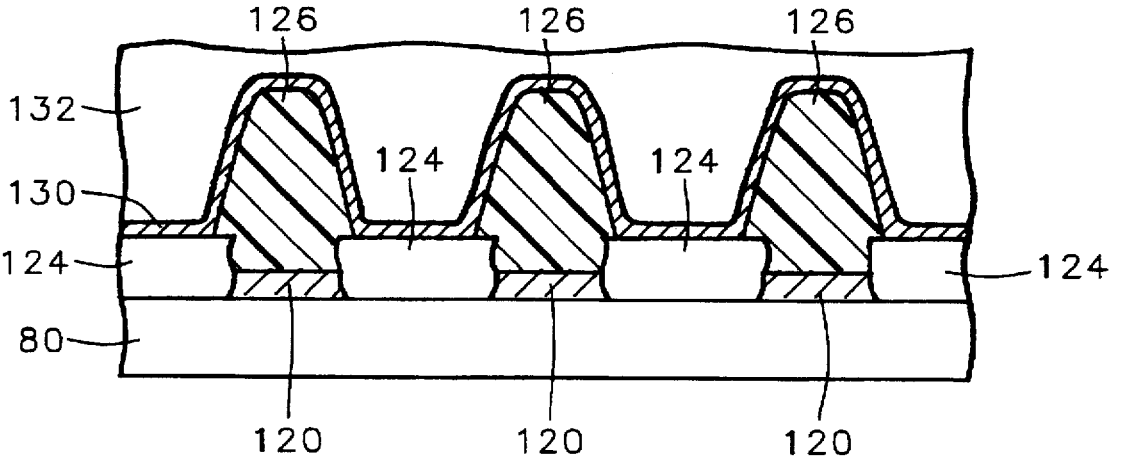

A second thick photoresist mask 126 is now formed, as depicted in FIG. 18, to a thickness of between about 20 and 100 micrometers. Due to the thickness of this photoresist, patterning requires UV or x-ray exposure, in order to form openings 128. Sloped sides result, over which is formed reflective layer 130, both as described previously. However, reflective layer 130 can be optionally deposited by sputtering. A paste 132, which could be formed of, for example, glass frit, to a thickness of between about 20 and 100 micrometers, is cast over the reflective layer, typically by dispensing and printing.

Figure 20:
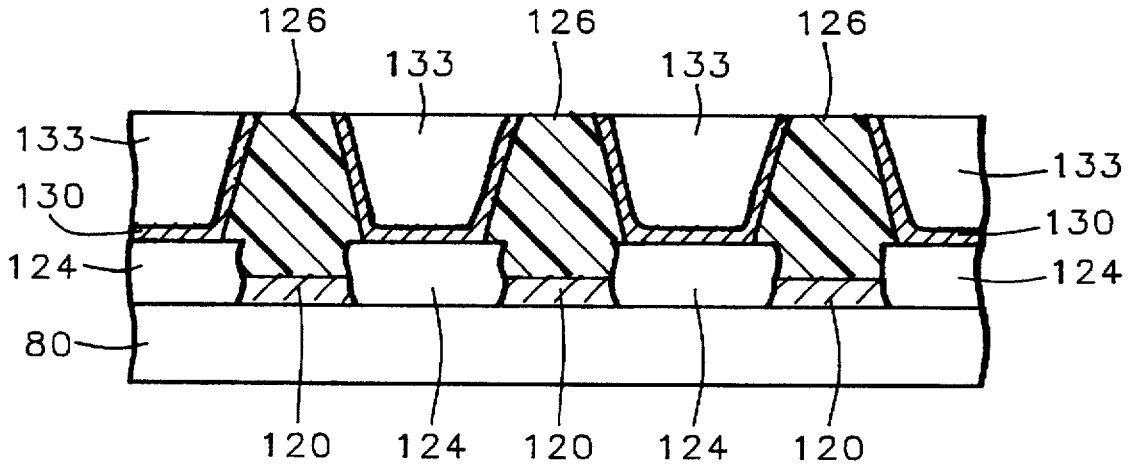
Figure 21:
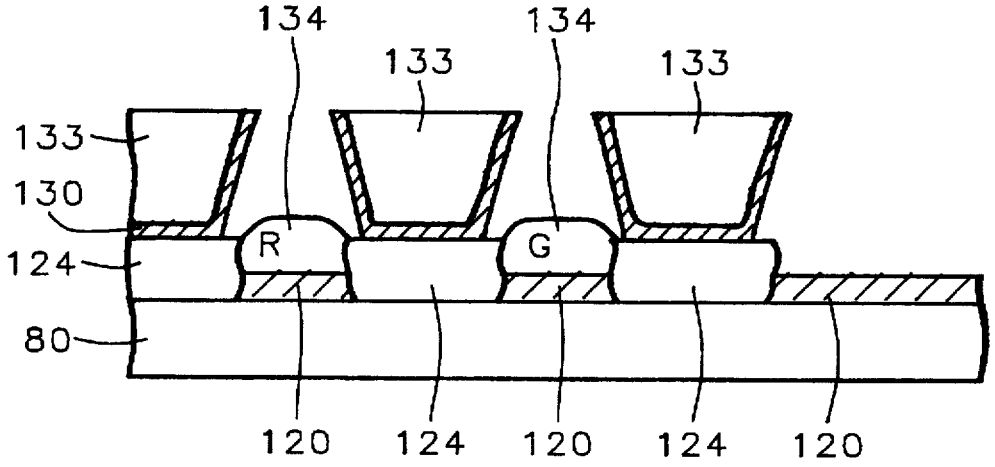

Referring now to FIG. 20, the tops of paste layer 132 and reflective layer 130 are removed, down to the level of, and thus exposing, photoresist 126. This is accomplished by chemical/mechanical polishing (CMP) or by lapping, as is well known in the art. Glass elements 133 remain. Finally, as shown in FIG. 21, the photoresist is dissolved and removed, and phosphors 134 are formed by electrophoresis. This final method requires two photolithographic steps, and also self-aligns the black matrix and phosphors.

While the invention has been particularly shown and described with reference to the preferred embodiments thereof, it will be understood by those skilled in the art that various changes in form and details may be made without departing from the spirit and scope of the invention.

What is claimed is:

1. A faceplate for a display device, comprising:

a glass face;

phosphor elements on said glass face; and reflective elements, on said glass face and adjacent to said phosphor elements, with surfaces forming an angle with said glass face of between about 45 and 75 degrees and wherein said phosphor elements are located within said angle, wherein said reflective elements are discontinuous, whereby light emitted from said phosphor elements reflects off said reflective elements and travels through said glass face, and further comprising transparent, conductive elements between said phosphor elements and said glass face.

2. The faceplate of claim 1 wherein said reflective elements are aluminum.

3. The faceplate of claim 1 wherein said reflective elements are directly adjacent to said phosphor elements.

4. The faceplate of claim 1 wherein said reflective elements are offset from said phosphor elements.

5. The faceplate of claim 1 further comprising contrast-providing material between said phosphor elements.

6. The faceplate of claim 1 wherein said display device is a field emission display.

7. A field emission display, comprising:

a faceplate having a glass face;

phosphor elements on said glass face;

reflective elements, on said glass face and adjacent to said phosphor elements, with surfaces forming an angle with said glass face of between about 45 and 75 degrees and wherein said phosphor elements are located within said angle, wherein said reflective elements are discontinuous, and angled toward said phosphor elements, whereby light emitted from said phosphor elements reflect off said reflective elements and travels through said glass face;

transparent, conductive elements between said phosphor elements and said glass face; and a baseplate having a plurality of electron-emitting elements and a means for causing said electron-emitting by field emission, said baseplate being mounted parallel and opposite to said faceplate.

8. The faceplate of claim 7 wherein said reflective elements are aluminum.

9. The faceplate of claim 7 wherein said reflective elements are directly adjacent to said phosphor elements.

10. The faceplate of claim 7 wherein said reflective elements are offset from said phosphor elements.

11. The faceplate of claim 7 further comprising contrast-providing material between said phosphor elements.

* * * * *